US008096852B2

(12) United States Patent
Deshpande et al.

(10) Patent No.: US 8,096,852 B2
(45) Date of Patent: Jan. 17, 2012

(54) IN-SITU PERFORMANCE PREDICTION OF PAD CONDITIONING DISK BY CLOSED LOOP TORQUE MONITORING

(75) Inventors: Sameer Deshpande, Milpitas, CA (US); Shou-Sung Chang, Stanford, CA (US); Hung Chih Chen, Sunnyvale, CA (US); Roy C Nangoy, Santa Clara, CA (US); Stan D Tsai, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 45 days.

(21) Appl. No.: 12/187,637

(22) Filed: Aug. 7, 2008

(65) Prior Publication Data

US 2010/0035525 A1 Feb. 11, 2010

(51) Int. Cl.
*B24B 49/18* (2006.01)

(52) U.S. Cl. ..... 451/5; 451/56; 451/72

(58) Field of Classification Search ..... 451/5, 21, 451/56, 72, 443, 444
See application file for complete search history.

(56) References Cited

U.S. PATENT DOCUMENTS 6,191,038 B1 2/2001 Yoshida et al.
6,306,008 B1 * 10/2001 Moore ..... 451/5
6,343,974 B1 2/2002 Franca
6,517,414 B1 2/2003 Tobin et al.
6,623,334 B1 9/2003 Birang et al.
6,695,680 B2 2/2004 Choi et al.
6,722,948 B1 4/2004 Berman
6,796,885 B2 9/2004 Vanell
6,887,129 B2 5/2005 Birang et al.
6,931,330 B1 8/2005 Yi et al.
6,953,382 B1 10/2005 Korovin et al.
7,066,787 B2 6/2006 Nakanishi et al.
7,101,252 B2 9/2006 Kitajima et al.
7,108,579 B2 9/2006 Wada et al.
7,150,675 B2 12/2006 Kramer et al.
2004/0132309 A1 7/2004 Sakuma et al. ..... 438/692
2004/0242122 A1 12/2004 Kramer et al. ..... 451/5

* cited by examiner

*Primary Examiner* — Robert Rose
(74) *Attorney, Agent, or Firm* — Dergosits & Noah LLP

(57) ABSTRACT

Polishing pads used in CMP machines are consumable components that are typically replaced after a specific number of wafers have been processed. The life of a polishing pad is optimized by controlling the rate of material removal from the polishing pad by the conditioning disk. The conditioning disk removes enough material so the polishing surface can properly process the wafers but does not remove any excess material. Preventing excess material removal extends the life of the polishing pad. During CMP processing, the controller receives data concerning the torque applied to the conditioning disk and the torque applied to the arm to sweep the conditioning disk across the polishing pad. Based upon the detected operating conditions, the system can predict the rate of material removal and adjust the forces applied to the conditioning disk so that the life of the polishing pad is optimized.

28 Claims, 4 Drawing Sheets

IN-SITU PERFORMANCE PREDICTION OF PAD CONDITIONING DISK BY CLOSED LOOP TORQUE MONITORING

FIELD OF INVENTION

The present invention relates to a method and apparatus for conditioning a polishing pad used in chemical mechanical polishing (CMP) to manufacture semiconductor devices.

BACKGROUND

A conventional CMP machine includes a rotating polishing pad, a wafer carrier and a conditioning disk with an abrasive surface used to condition the polishing pad. During CMP processing, a liquid slurry of abrasive particles is poured onto the rotating polishing pad and a semiconductor wafer is placed in the wafer carrier. The wafer carrier presses the wafer against the slurry and the rotating polishing pad while the carrier moves the wafer across the width of the polishing pad. The chemical reaction with the slurry and the physical erosion due to the contact with the abrasive particles causes material to be removed from the wafer and evens out any irregular topography, making the exposed wafer surface planar. The conditioning disk includes an abrasive surface and is coupled to an arm that rotates the conditioning disk and sweeps the conditioning disk abrasive surface against the polishing pad surface. The conditioning disk keeps the particles removed from the wafer from accumulating on the polishing pad surface and maintains the uniform abrasive character of the polishing pad.

In a normal CMP system, the conditioning disk actuator applies a constant compressive force to press the conditioning disk against the polishing pad. The conditioning disk also rotates at a constant rate of rotation and the conditioning disk is moved across the radius of the polishing pad at a constant sweep rate. When a new polishing pad and a new conditioning disk are installed in a CMP machine, the abrasive surface of the conditioning tends to be very sharp and the rate of material removal from the polishing pad is initially high. During the life of the conditioning disk, the abrasive surface is worn down and the sharpness of the conditioning disk is reduced. This causes the rate of material removal to be reduced as the conditioning disk is used. Thus, in a prior art CMP machine, the rate of material removal is not controlled and the rate of material removal from the polishing pad is not linear throughout the life of a polishing pad. Accordingly, what is needed is a CMP control system that monitors the status of the conditioning disk and adjusts the rate of material removal to optimize the life of the polishing pad.

SUMMARY OF THE INVENTION

The present invention is directed towards a system and method for optimizing the life of the polishing pad. The system includes a rotating polishing pad, a wafer carrier, a conditioning disk, a conditioning disk actuator and a closed-loop control system. The wafer carrier holds the wafer against the rotating polishing pad that is coated with abrasive slurry. The carrier rotates and moves the wafer across the width of the polishing pad. As material is removed from the wafer, the wafer is polished to a smooth flat surface. The conditioning disk has an abrasive surface that can include many small diamonds. During CMP processing, the conditioning disk is rotated and its abrasive surface is moved across the width of the polishing pad. The abrasive surface of the conditioning disk cleans the wafer particles from the polishing pad and also conditions the polishing pad for uniform polishing. During the conditioning process, some of the polishing pad material is removed by the conditioning disk.

The rate of material removal from the polishing pad is critical to optimizing its performance and life. If excess material is removed from the polishing pad during the conditioning process, the extra material that is removed shortens the life of the polishing pad. Conversely, if an insufficient amount of material is removed from the polishing surface, the polishing surface will not be properly conditioned, i.e., un-desired particles may remain and the pads nominal surface characteristics may not be returned and, as a result, the wafers may not be properly polished. Thus, for optimum conditioning of the polishing pad, the material removed from the polishing pad surface must be closely controlled so that sufficient conditioning is performed without removing any excess material that would unduly shorten the life of the polishing pad.

The inventive CMP system includes a closed-loop control system that monitors the friction between the polishing disk and the conditioning pad as a way to monitor polishing disk performance and to estimate the remaining polishing disk life to determine an accurate time for polishing disk replacement. Polishing disk conditioning is accomplished by controlling the rate of material removal from the polishing pad by adjusting the compressive force applied to the conditioning disk, the speed of rotation of the conditioning disk, and the sweep rate of the conditioning disk arm. These parameters can be controlled individually or in combination. The rate of material removal during conditioning is increased when the compressive force, the rotation or the sweep rate is increased. Conversely, the rate of material removal during conditioning is decreased when any of the compressive force, the rotation or the sweep rate is decreased.

In order to control the rate of material removal, the system must predict the rate of material removal. The rate of material removal from the polishing pad can be influenced by the sharpness of the abrasive surface of the conditioning disk, the compressive force, the rate of rotation and the sweep rate. The abrasive surface is made from a plurality of sharp cutting edges formed by many diamonds. As the conditioning disk is used, the sharp edges are worn down and the friction between the polishing pad is reduced. In one embodiment, the cumulative effect of these operating conditions may be measured by the rotational torque applied to the conditioning disk and the sweep torque applied to the conditioning disk arm. A rotational torque sensor can be coupled to the conditioning disk to detect the rotational torque of the conditioning disk and a sweep torque sensor can be coupled to the arm to detect the sweep torque used to move the conditioning disk across the polishing pad. A closed-loop control system controller can receive data concerning the rotational torque and the sweep torque applied to the conditioning disk and the controller makes adjustments to controllable operating conditions to maintain the rate of material removal from the conditioning disk at a constant rate to optimize the life of the polishing pad.

When the conditioning disk is new, the abrasive surface can be sharp and the amount of friction between the conditioning disk abrasive surface and the polishing pad can be large. Because of this large amount of friction, the magnitude of the detected rotational torque or the magnitude of the sweep torque may exceed the target range for a preferred rate of material removal. In order to reduce the torque, the control system can decrease the compressive force, rate of rotation and/or sweep rate applied to the conditioning disk. As the conditioning pad abrasive surface is worn down, the amount of friction between the conditioning disk abrasive surface and the polishing pad decreases and the controller must increase the compressive force, rate of rotation and/or sweep rate of the conditioning disk to bring the magnitude of the rotational torque back up to the pre-defined range. Thus, based upon data concerning the rotational torque and the sweep torque, the closed-loop control system can control the rotation torque and sweep torque applied to the conditioning disk so that the rate of material removal from the polishing pad surface is optimized for longer useful life. By controlling the rate of material removal, the change in polishing pad thickness can be substantially the same for each wafer processed. Thus, for the inventive CMP system, the change in polishing pad thickness can be directly correlated to the number of wafers processed.

Various system configurations are possible. In some embodiments, the CMP system may include both a rotational torque sensor and a sweep torque sensor. Alternatively, the CMP system can include only the rotational torque sensor or only the sweep torque sensor. The system can control the rate of material removal by altering (1) the compression; (2) the rate of rotation; or, (3) the sweep rate of the conditioning disk, either individually or in some combination.

The controller can operate in many different ways. For example, as described in one embodiment above, the controller can receive data concerning the magnitude of the rotational torque applied to the conditioning disk and/or the magnitude of the sweep torque applied to the arm, and controller can determine if the detected torques are within a pre-defined range of values. The rate of material removal from the polishing pad surface correlates with the rotational torque and the sweep torque. Thus, each torque value will have an associated rate of material removal. If the magnitude of the detected torques are outside the pre-defined ranges, the closed loop control system can adjust the controllable operating conditions during wafer processing to optimize the rotational and sweep torques within pre-defined ranges. Thus, the rate of material removal from the polishing pad surface is controlled to provide long life.

In another embodiment, the controller can use an algorithm to predict the rate of material removal from the polishing pad. The controller can constantly run the algorithm based upon the detected operating conditions and predict the rate of material removal. If the predicted rate of material removal from the polishing pad surface is outside of the pre-defined rate of material removal, the controller can adjust the controllable operating conditions according to provide the algorithm at the preferred rate of material removal.

In another embodiment, the controller can be coupled to a database that stores the expected or historical CMP process measurements. The controller can then compare the detected operating conditions to the stored data. If the measured operating condition data deviates from the stored data, the controller adjusts the controllable operating conditions to provide the preferred rate of material removal.

DETAILED DESCRIPTION

Figure 1:
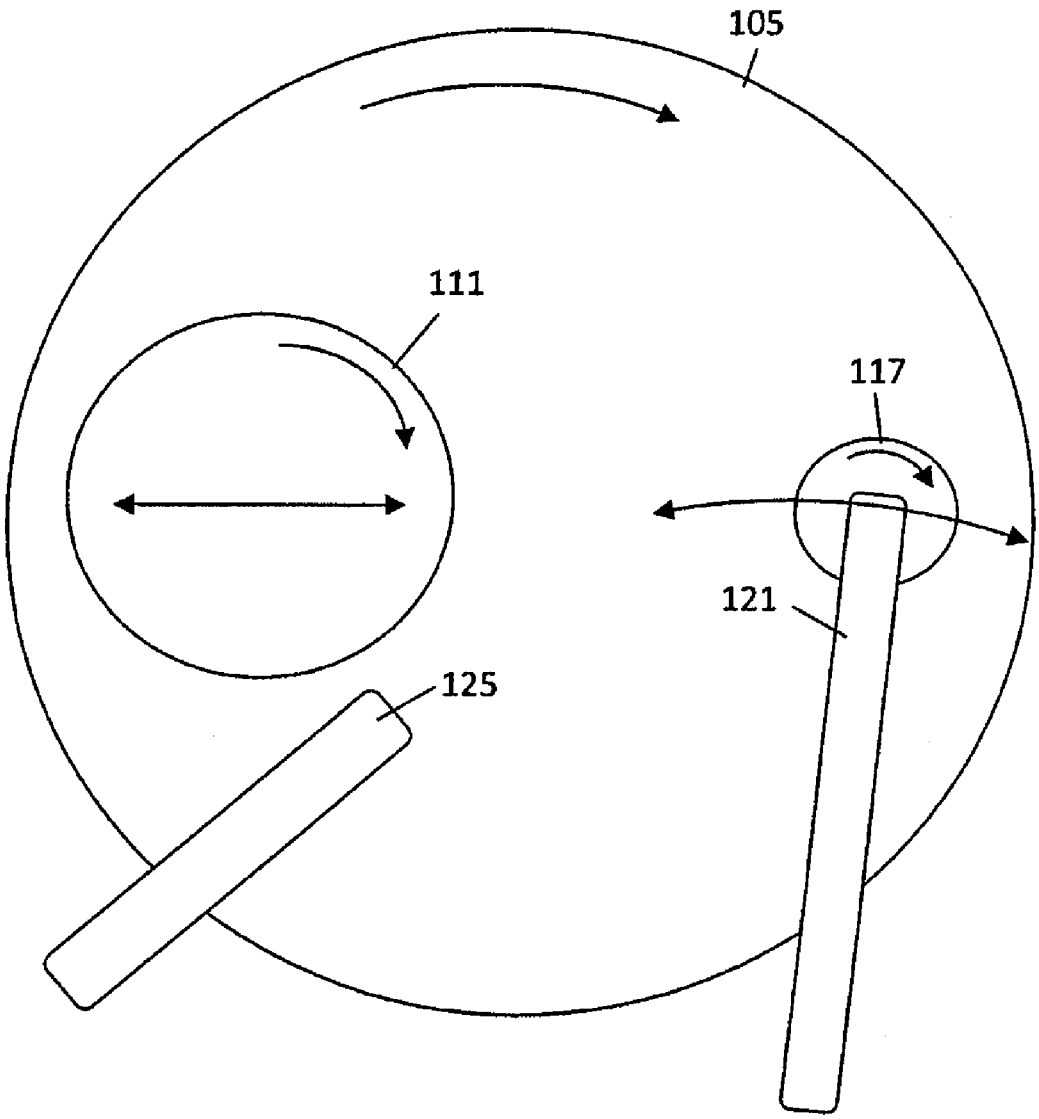
FIG. 1 illustrates a top view of a CMP system.

The present invention is directed towards an improved apparatus and method for optimizing the processing life of a CMP polishing pad. The inventive system detects the magnitude of the torque forces applied to the conditioning disk to condition the polishing pad and adjusts the operation of the conditioning disk to optimize the performance and life of the polishing pad. With reference to FIG. 1, a preferred embodiment of the CMP system includes a rotating circular polishing pad 105, a wafer carrier mechanism 111, a conditioning disk 117 and a conditioning disk arm. During CMP processing, abrasive slurry is poured onto the polishing pad 105 by a slurry distribution mechanism 125. The wafer carrier mechanism 111 rotates and moves the wafer over the slurry and across the width of the rotating polishing pad 105. The conditioning disk 117 has an abrasive surface that contacts the polishing pad 105 and removes wafer particles from the polishing surface. The conditioning disk 117 is swept back and forth across the width of the polishing pad 105 with a sweep actuator that is coupled to a conditioning disk arm 121.

Figure 2:
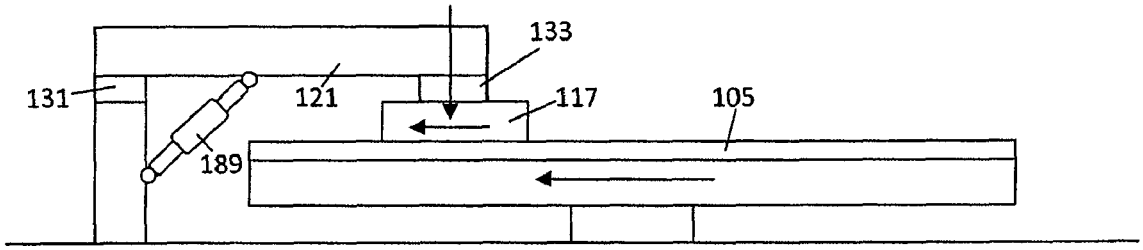
FIG. 2 illustrates a side view of the CMP system.

With reference to FIG. 2, the compression of the conditioning disk 117 against the polishing pad 105 is controlled with a compression actuator 189. A rotational torque sensor 133 detects the magnitude of the rotational torque applied to the conditioning disk 117. A sweep torque sensor 131 is coupled to the arm 121 to detect the magnitude of the sweep torque applied to the arm 121. The magnitude(s) of the rotational torque and/or the sweep torque applied to the conditioning disk are sent to a controller that uses this torque data to predict the rate of material removal from the polishing pad 105 during CMP processing. The polishing pad 105 and a conditioning disk 117 are consumable components that are typically replaced after the polishing pad 105 has processed a specific number of wafers and the polishing pad has been worn to a pre-defined minimum thickness. In this preferred embodiment, the life of the polishing pad 105 is extended by controlling the rate of material removal by the conditioning disk 117 during CMP processing so that only enough material is removed to condition the polishing pad surface, and an excessive amount of material is not unnecessarily removed.

In contrast, the prior art CMP systems may not control the rate of material removal during conditioning. The compressive force applied to the conditioning disk, the rotational velocity of the conditioning disk and the sweep rate of the conditioning disk across the polishing pad are held constant throughout the life of the polishing pad in these prior art systems. This method is inefficient because the actual wear rate of the polishing pad is not linear. When a new polishing pad and conditioning disk are installed on a CMP machine, the abrasive surface of the conditioning disk is sharp and the rate of material removal from the polishing pad surface is initially higher than might be necessary to condition the polishing surface. As the abrasive surface of the polishing pad is worn down, the rate of material removal from the polishing pad is reduced. Thus, all of the material removed beyond that required to condition the polishing surface is wasted.

Figure 3:
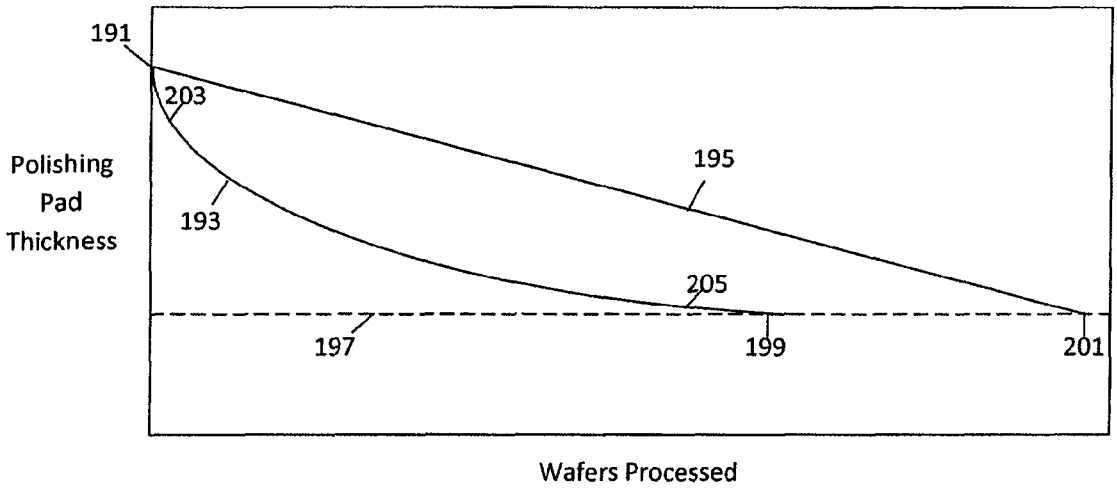
FIG. 3 is a graph showing the change in the polishing pad thickness based upon the quantity of wafers processed.

With reference to FIG. 3, a graph is shown with the polishing pad thickness in the vertical axis plotted against the number of wafer processed on the horizontal axis. A prior art CMP machine polishing pad is represented by the curved line 193. The polishing pad is initially at the full thickness 191. As wafers are processed, the polishing pad is worn down by the conditioning disk. As discussed, a constant compressive force is applied to the conditioning disk and the rate of material removal is initially very high, represented by the steep slope 203 on the left side of the graph. The rate of material removal decreases as more wafers are processed and eventually the rate of material removal lessens, represented by the taper into a more gradual slope 205 as additional wafers are processed. The polishing pad comes to the end of its life when the thickness of the polishing pad wears down to a minimum thickness represented by the dashed line 199. According to this prior art technique, since the thickness is not actually measured, the polishing pad and the conditioning disk are replaced after a predetermined number of wafers have been processed, without regard to their actual condition.

In contrast, a CMP processing system, according to one embodiment of the present invention, is represented by the solid line 195. The system controls the rate of material removal so that the rate of material removal is sufficient to properly condition the polishing pad surface. Because the material removal is controlled by data points whose values influence conditioning operating conditions, excessive material removal is avoided. Since a consistent amount of material is removed with each wafer that is processed, the change in thickness is represented by a straight line 195. A graphical representation of the extended life of the polishing pad is represented by the vertical distance between the line 193 for the prior art CMP machine and the line 195 for an embodiment of the CMP system of the present invention.

The total number of wafers processed using the prior art CMP method is represented by the intersection 199 of the line 193 with the minimum thickness 197. The total number of wafers processed using an embodiment of the inventive CMP method is represented by the intersection 201 of the line 195 with the minimum thickness 199. Because the rate of wear is more gradual, and excessive material is not removed at the initial processing, the life of the consumable polishing pad surface is thereby extended. Thus, in this embodiment of the inventive system, it is able to polish significantly more wafers than the prior art systems.

In order to optimize the life of the polishing pad surface, in an embodiment, the system can include a controller that is configured to monitor the operating conditions of the CMP machine and control the rate of material removal from the polishing pad. The rate of material removal from the polishing pad surface can be correlated with the rotational torque and sweep torque when the conditioning disk abrasive surface is applied to the polishing pad surface. The torques are correlated with the amount of friction between the conditioning disk and the polishing pad, the compressive force of the conditioning disk against the polishing pad, the rate of rotation of the conditioning disk and the sweep rate of the conditioning disk arm.

The torque magnitudes detected by the torque sensors can vary depending upon the location of the conditioning disk. For example, as the arm sweeps the conditioning disk from side to side, the arm accelerates at the beginning of each sweep and decelerates at the end of each sweep. Thus, the detected torque includes the friction of the conditioning disk as well as the movement acceleration and deceleration of the arm. In order to remove the effects of acceleration and deceleration from the detected sweep torque, the system may only read sweep torque when the arm is rotating at a constant velocity in the middle of each sweep. Alternatively, the system may predict the acceleration and deceleration based upon well known physics formulas, torque=(mass) (acceleration) (arm length). Thus, the system can remove the acceleration component from the detected torque.

The forces required to move the conditioning disk over the polishing pad can also vary depending upon the relative sliding velocity of the conditioning disk over the polishing pad. The relative sliding velocity changes depending upon the radial position of the conditioning disk over the polishing pad. The relative velocity will be higher at the outer radius than at the center of the polishing pad. In an embodiment, the inventive system can optionally use a rotational position sensor to detect the radial position of the arm, and the system controller can adjust the detected torque magnitudes to account for these variations in sliding velocity. By accounting for these variations in this embodiment, the inventive system can more accurately predict the rate of material removal.

Because changes in the operating conditions of the conditioning disk can have different effects on the detected rotational torque or sweep torque, the controller may optionally adjust one of the operating conditions if only one of the detected torques is out of the corresponding pre-defined range. For example, the rotational torque sensor 133 may be more responsive to changes in the rotation rate 163 of the conditioning disk than the sweep torque sensor 131. Thus, if the sweep torque 131 is within the pre-defined range but the rotational torque 133 is below the pre-defined range, the controller 173 can increase the rotation rate 163 of the conditioning pad 175 to correct the magnitude of the rotational torque 133 while not significantly altering the magnitude of the sweep torque 131. In another example, if the rotational torque 133 is within the pre-defined range but the sweep torque 131 is below the pre-defined range, the controller 173 can decrease the sweep rate 165 to bring the magnitude of the detected sweep torque 131 into the pre-defined range while not significantly altering the magnitude of the rotational torque 133. Altering the compressive force 161 may equally alter both the magnitude of the rotational torque 133 and the magnitude of the sweep torque 131. Thus, embodiments of the inventive system can be configured to monitor various different processing conditions and make corrective adjustments according to the type of variations detected.

Figure 4:
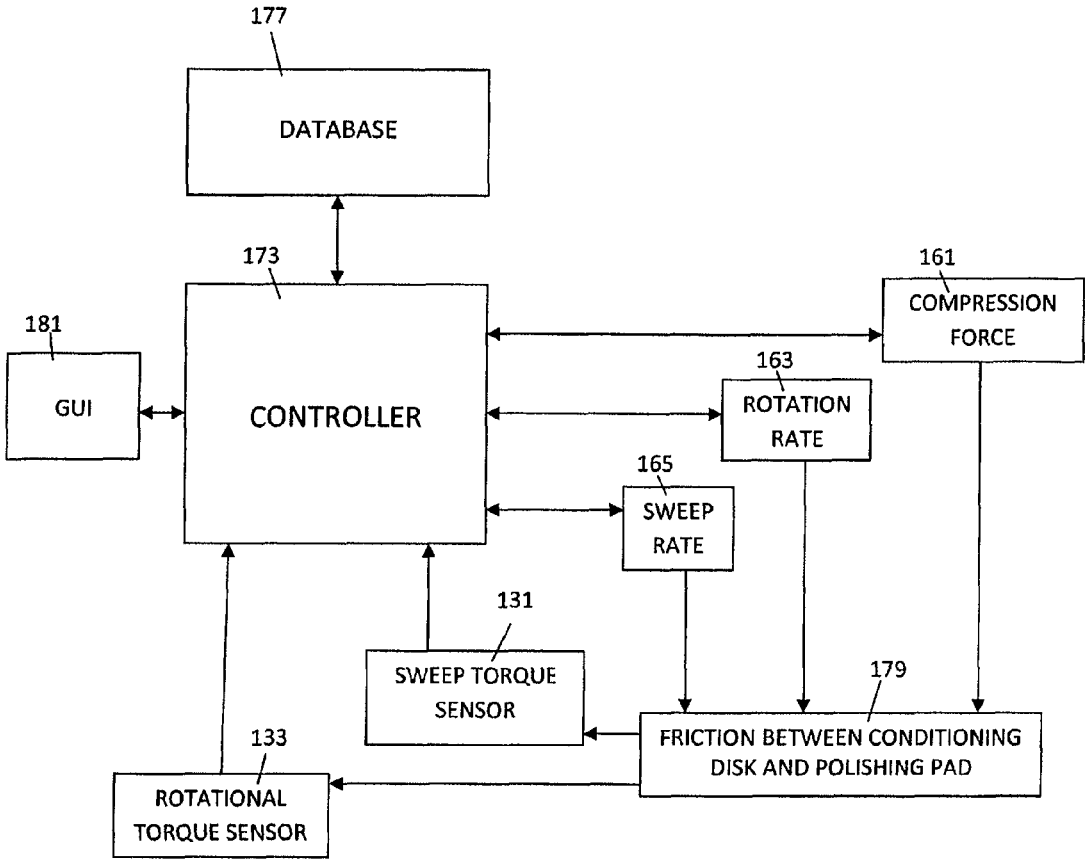
FIG. 4 illustrate a block diagram of the CMP control system.

With reference to FIG. 4, a block diagram of an embodiment of the closed loop control system is illustrated. During processing, the conditioning disk abrasive surface is pressed against the polishing pad surface and the magnitude of the rotational friction between the conditioning disk and the polishing pad 141 is detected by the rotational torque sensor 131 and/or the sweep torque sensor 133. The controller 173 is coupled to receive data from the rotational sensor 133 that monitors the rotational torque applied to the conditioning disk. The controller 173 may also be coupled to receive data from the sweep torque sensor 131 that monitors the sweep torque applied to the conditioning disk arm. In addition to the detected torques, the controller may also receive data concerning the number of wafers processed, the compression force 161, the rate of rotation 163, and the sweep rate 165 of the conditioning disk, all potentially useful to predict the rate of material removal from the polishing pad surface. Based upon the detected processing information, the controller 173 can predict the rate of material removal from the polishing pad surface and make adjustments to the compression force 161, the rate of rotation 163 and the sweep rate 165. The controller 173 can also be coupled to (1) a graphical user interface 181 that allows a user to control the operation of this embodiment of the inventive CMP system, and (2) a network that allows the system to communicate with other digital devices.

The controller 173 can have various modes of operation. In an embodiment, the system can be configured to maintain the magnitude of the rotational torque and/or the magnitude of the sweep torque within specific pre-defined ranges. If the detected magnitude of the rotational or sweep torques are outside the pre-defined ranges, the controller 173 can adjust the compression force 161, the rate of rotation 163 and the sweep rate 165, individually or in combination, to correct the rate of material removal from the polishing pad surface.

In a first exemplary mode of operation, the controller 173 can be configured to receive data concerning the magnitude of the rotational torque 133 applied to the conditioning disk. The controller 173 maintains the magnitude of the rotational torque 133 with a pre-defined range. In an embodiment, the controller may only be able to adjust the compression force 161 to control the friction between the conditioning disk and the polishing pad 179. If the friction between the conditioning disk and the polishing pad 179 is above the pre-defined level, the rotational torque sensor 133 will deliver the data to the controller 173 which will reduce the compression force 161 to reduce the friction. Conversely, if the friction between the conditioning disk and the polishing pad 179 is below the pre-defined level, the rotational torque sensor 133 will deliver the data to the controller 173 which will increase the compression force 161 to increase the friction. In other modes of operation, the system can detect any combination of operating conditions and control the operating conditions to control the rate of material removal. By controlling the rate of material removal, the polishing pad is worn down in a linear manner and the life of the pad 105 can be optimized.

In other embodiments, the controller 173 can include a microprocessor that utilizes an algorithm that predicts the rate of material removal from the polishing pad surface. The algorithm may be based upon the relationship between the various operating conditions. The rate of material removal is correlated with the compression force 161, the rotational speed of the conditioning disk 163, the sweep rate of the conditioning disk 165, the rotational torque 133 and the sweep torque 135 applied to the conditioning disk and the speed of the abrasive surface over the polishing pad. The rate of material removal will increase when any of these conditions are increased and decrease when any of the operating conditions are decreased.

Since each of these operating conditions will have a different quantitative effect on the rate of material removal, correction factors can be applied to each of the detected operating conditions. An effective algorithm can include any detected processing condition or a combination of detected processing conditions. A generalized rate of material removal equation can be:

$$\text{Rate Of Material Removal}=X_1T_R+X_2T_S+X_3C+X_4R+X_5S$$

Where:

$X_1$-$X_5$ Correction factors for the detected operating conditions $T_R$ Rotational torque applied to the conditioning disk $T_S$ Sweep torque applied the conditioning disk arm C Compression force applied to the conditioning disk R Rate of rotation of the conditioning disk S Sweep rate of the conditioning disk In yet another embodiment, the system controller is coupled to data storage and the controller can compare some or all of the actual detected operating conditions to a database 177 that may include historical data and/or target performance data. The controller 173 can determine if any of the detected operating conditions are out of the pre-defined ranges and if an error is detected, the controller can make the necessary adjustments to the compression force 161, the rate of rotation 163 and/or the sweep rate 165. By constantly receiving data concerning the operating conditions, and comparing the detected values to the pre-defined values, errors can be quickly detected and all necessary adjustments can be made by the controller 173. The system rate can maintain the rate of material removal from the polishing pad at the optimum level.

In an embodiment, the database 177 includes historical processing data and as well as end of life and error conditions. The historical data can include the expected rotational torque and expected sweep torque magnitudes for certain operating conditions. For example, if a CMP system is operating at a specific compression force, rotation rate and sweep rate and the conditioning disk has processed 205 wafers, the database may have processing data for the magnitude of the expected rotational and sweep torques. If the magnitude of the detected rotational torque 133 or the sweep torque 131 are substantially different than the expected values or range, the system can identify the error and emit a signal indicating that there is a problem with the CMP processing.

In an embodiment, the inventive system can be configured to emit an end of life signal when the system detects that certain operating conditions are met. For example, if the magnitude of the detected rotational and/or sweep torque falls below corresponding pre-defined values when a high compression force is applied, the system may detect that the polishing pad is worn out and cannot be properly conditioned. Alternatively, an error signal may be produced when the compression forces applied to the conditioning disk exceed a pre-defined value or the rate of rotation of the conditioning disk or sweep rate of the conditioning disk arm exceed pre-defined rates. In other embodiments, the inventive system can also detect errors in the CMP process when the torque sensors detect large variations in the magnitudes of either the rotational torque or the sweep torque. These variations may indicate that the polishing surface of the conditioning disk is uneven. For example, the inner radial area can be rougher than the outer radial area. Since the uneven surface will ultimately cause defects in the wafers being processed, the system can provide an error signal when significant variations are detected.

It will be understood that the inventive system has been described with reference to particular embodiments, however additions, deletions and changes could be made to these embodiments without departing from the scope of the inventive system. Although the CMP systems that have been described include various components, it is well understood that these components and the described configuration can be modified and rearranged in various other configurations.

What is claimed is:

1. An apparatus for chemical mechanical polishing comprising:

a rotatable polishing pad for processing wafers;

a rotatable conditioning disk having an abrasive surface for conditioning the polishing pad;

an arm coupled to the conditioning disk for Sweeping the conditioning disk abrasive surface across the polishing pad;

a sweeping actuator coupled to the arm for sweeping the arm over the polishing pad;

a sweep torque sensor coupled to the arm for detecting an amount of a sweep torque applied to the arm by the sweeping actuator;

a rotational torque sensor for detecting a rotational torque applied to the conditioning disk;

a compression actuator for adjusting a compressive force of the conditioning disk against the polishing pad; and a controller that receives rotational torque data from the rotational torque sensor and sweep torque data from the sweep torque sensor and uses the rotational torque data and the sweep torque data to adjust the compressive force applied to the conditioning disk by the compression actuator.

2. The apparatus of claim 1 wherein the controller maintains the magnitude of the rotational torque within a first pre-defined range.

3. The apparatus of claim 2 wherein the controller increases the compression force of the compression actuator on the conditioning disk if the magnitude of the rotational torque falls below the minimum value in the first pre-defined range.

4. The apparatus of claim 2 wherein the controller decreases the compression force of the compression actuator on the conditioning disk if the magnitude of the rotational torque rises above the maximum value in the first pre-defined range.

5. The apparatus of claim 1 further comprising a sweep torque sensor coupled to the arm for detecting an amount of a sweep torque required to move the conditioning disk across the polishing pad.

6. The apparatus of claim 1 wherein the controller receives sweep torque data from the sweep torque sensor and the controller maintains the magnitude of the sweep torque within a second pre-defined range.

7. The apparatus of claim 6 wherein the controller increases the compression force of the compression actuator on the conditioning disk if the magnitude of the sweep torque falls below the minimum value in the second pre-defined range.

8. The apparatus of claim 6 wherein the controller decreases the compression force of the compression actuator on the conditioning disk if the magnitude of the sweep torque rises above the magnitude value in the second pre-defined range.

9. The apparatus of claim 1 further comprising:

a microprocessor and programmed with an algorithm that predicts a rate of material removal from the polishing pad based upon the magnitude of the rotational torque.

10. The apparatus of claim 1 further comprising:

a database storing an expected rotational torque range;

wherein the magnitude of the rotational torque is compared to the expected rotational torque range to determine if the magnitude of the rotational torque is within the expected rotational torque range.

11. A method for chemical mechanical polishing comprising:

providing a rotatable polishing pad for processing wafers, an arm coupled to the conditioning disk for sweeping the conditioning disk abrasive surface over the polishing pad and a rotatable conditioning disk with an abrasive surface;

conditioning the polishing pad by rotating the conditioning disk abrasive surface against the polishing pad;

detecting a rotational torque applied to the conditioning disk;

detecting an amount of a sweep torque applied to the arm that sweeps the conditioning disk across the polishing pad;

adjusting a compressive force of the conditioning disk against the polishing pad to maintain the magnitude of the rotational torque within a first pre-defined range; and the sweep torque within a second pre-defined range.

12. The method of claim 11 further comprising:

increasing the compressive force of the conditioning disk against the polishing pad if the magnitude of the detected rotational torque falls below the minimum value in the first pre-defined range.

13. The method of claim 11 further comprising:

decreasing the compressive force of the conditioning disk against the polishing pad if the magnitude of the detected rotational torque rises above the maximum value in the first pre-defined range.

14. The method of claim 11 further comprising;

increasing a rotation rate of the conditioning disk if the magnitude of the detected rotational torque falls below the minimum value in the first pre-defined range.

15. The method of claim 11 further comprising:

decreasing a rotation rate of the conditioning disk if the magnitude of the detected rotational torque rises above the maximum value in the first pre-defined range.

16. The method of claim 11 further comprising:

increasing a sweep rate of the arm if the magnitude of the detected sweep torque falls below the minimum value in the first pre-defined range.

17. The method of claim 11 further comprising:

decreasing a sweep rate of the arm if the magnitude of the detected sweep torque rises above the maximum value in the first pre-defined range.

18. The method of claim 11 further comprising:

predicting a rate of material removal from the polishing pad using an algorithm based upon the magnitude of the rotational torque.

19. The method of claim 11 further comprising:

providing a database storing an expected rotational torque range; and comparing the magnitude of the rotational torque to the expected rotational torque range to determine if the magnitude of the rotational torque is within the expected rotational torque range.

20. A method for chemical mechanical polishing comprising:

providing a rotatable polishing pad for processing wafers, a rotatable conditioning disk with an abrasive surface, and an arm coupled to the conditioning disk for sweeping the conditioning disk abrasive surface over the polishing pad;

conditioning the polishing pad by rotating the conditioning disk abrasive surface against the polishing pad;

detecting a sweep torque applied to the arm to sweep the conditioning disk across the polishing pad; and adjusting a compressive force of the conditioning disk against the polishing pad to maintain the magnitude of the detected sweep torque within a pre-defined range.

21. The method of claim 20, further comprising:

using the sweep torque detected to determine an in-process condition of the conditioning disk.

22. The method of claim 20, further comprising, using the sweep torque detected to determine a time for replacing the conditioning disk.

23. The method of claim 20 further comprising:

increasing the compression force of the actuator on the conditioning disk if the magnitude of the detected sweep torque falls below a minimum value in the pre-defined range.

24. The method of claim 20 further comprising:

decreasing the compression force of the actuator on the conditioning disk if the magnitude of the detected sweep torque rises above a maximum value in the pre-defined range.

25. The method of claim 20 further comprising;

increasing a sweep rate of the arm if the magnitude of the detected sweep torque falls below a minimum value in the pre-defined range.

26. The method of claim 20 further comprising:

decreasing a sweep rate of the arm if the magnitude of the detected sweep torque rises above a maximum value in the pre-defined range.

27. The method of claim 20 further comprising:

predicting a rate of material removal from the polishing pad using an algorithm based upon the magnitude of the sweep torque.

28. The method of claim 20 further comprising:

providing a database storing an expected sweep torque range; and comparing the magnitude of the rotational torque to the expected sweep torque range to determine if the magnitude of the sweep torque is within the expected sweep torque range.

* * * * *